US006111366A

United States Patent [19]

Olsson et al.

[11] Patent Number: 6,111,366

[45] Date of Patent: Aug. 29, 2000

[54] IGNITION TRANSFORMER FOR GAS DISCHARGE BULBS

[75] Inventors: Kent Olsson, Köpingsvik, Sweden; Jörg Niggemeyer, Buchholz, Germany

[73] Assignee: Ultralux AB, Göteborg, Sweden

[21] Appl. No.: 09/095,085

[22] Filed: Jun. 9, 1998

[30] Foreign Application Priority Data

Jun. 10, 1997 [SE] Sweden ..... 9702217

[51] Int. Cl.[7] ..... H05B 41/10

[52] U.S. Cl. ..... 315/276; 315/209 M; 336/220

[58] Field of Search ..... 336/220, 221, 336/234, 233, 180, 182, 90, 92, 96; 315/274, 276, 278

[56] References Cited

U.S. PATENT DOCUMENTS 2,474,666 6/1949 Haantjes et al. ..... 336/220

4,184,103 1/1980 Stein ..... 315/276

5,072,158 12/1991 Schuda ..... 315/276

5,448,217 9/1995 Luetzow ..... 336/180

*Primary Examiner*—Don Wong

*Assistant Examiner*—Tuyet Vo

*Attorney, Agent, or Firm*—Alfred J. Mangels

[57] ABSTRACT

An ignition transformer for gas discharge bulbs, or tubes, including a core, a primary coil, and a secondary coil. The transformer windings are wound axially along a rod-shaped core (1). The secondary winding includes two or more mutually concentric and axially extending windings (5, 6, 7), where each winding includes only one single layer. The primary winding (11) includes an axially extending winding that lies concentrically outside the outermost secondary winding (7).

6 Claims, 1 Drawing Sheet

IGNITION TRANSFORMER FOR GAS DISCHARGE BULBS

BACKGROUND OF THE INVENTION

1. Field of the Invention

The present invention relates to an ignition transformer for gas discharge bulbs or tubes.

Although the present invention is concerned primarily with gas discharge bulbs for vehicle headlamps, it is not restricted solely to such use.

2. Description of the Related Art

One problem with a gas discharge bulb, or tube, is that ionization of the gas in the bulb, and therewith ignition of the bulb, or tube, requires the application of a high voltage while a much lower voltage is required in operation, for instance an alternating voltage of from 65–105 V. The combination of a high ignition voltage and a low operating voltage with a high current strength during operation constitutes a well known problem.

It is difficult to generate a voltage that is high enough to give positive ignition and, at the same time, achieve high operating efficiencies by using one and the same circuit for both ignition and operating purposes.

Parallel connection of an ignition transformer with the drive circuit presents the problem of insulating and protecting the drive circuit with respect to the ignition pulse, and also presents problems with regard to switching from an ignition mode quickly enough to prevent the bulb from being extinguished.

Connection of the ignition transformer in series between the bulb and the drive circuit presents the problem of combining a high ignition voltage, which requires many winding turns, with a low impedance in the operating mode which requires few winding turns and/or the use of heavy gauge winding wire. Because the ignition voltage is as high as 20–30 kV, there is a significant risk of oversparking arid large insulation thicknesses are required. The requirement of small dimensions and low weight make these problems large problems.

These problems are solved by the present invention.

SUMMARY OF THE INVENTION

Thus, the present invention relates to an ignition transformer for gas discharge bulbs or tubes. The transformer includes a core, a primary winding, and a secondary winding, and the windings of the ignition transformer are wound axially along a rod-like core. The secondary winding includes two or more mutually concentric and axially extending windings, where each winding includes at least one layer. The primary winding is also an axially extending windily which lies concentrically outside the outermost secondary winding.

BRIEF DESCRIPTION OF THE DRAWINGS

The invention will now be described in more detail with reference to an exemplifying embodiment of the invention and also with reference to the accompanying drawing, in which.

DESCRIPTION OF THE PREFERRED EMBODIMENTS

Figure 1:
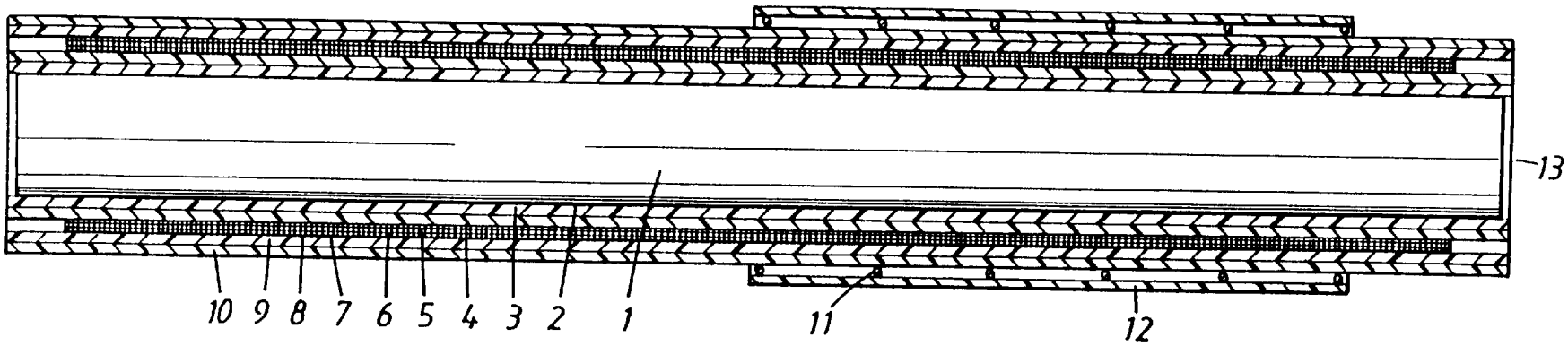
FIG. 1 illustrates an ignition transformer.

FIG. 1 shows an ignition transformer for gas discharge bulbs, or gas discharge tubes, which includes a core 1, a primary winding 11 and a secondary winding 5, 6, 7.

The inventive ignition transformer is intended to be coupled to a gas discharge lamp in series.

In accordance with the invention, the ignition transformer windings 5, 6, 7, 11 have been wound axially on a rod-like core 1. The rod is a ferrite rod. For instance, there is used a ferrite rod designated 38-004-59 AGENTEC, where the core material has the designation F59. In accordance with the invention, the secondary winding 8 includes two or more mutually concentric axially extending windings 5, 6, 7. Each winding in the secondary winding comprises only one single layer. The primary winding 8 11 also comprises an axially extending winding which lies concentrically outside the outermost secondary winding. The primary winding also consists of one single layer.

According to one highly preferred embodiment of the invention, the secondary windings 5, 6, 7 are mutually connected in parallel at respective ends of the transformer. Consequently, the resistance across the secondary winding, which thus includes two or more windings, will be low.

According to another highly preferred embodiment, the primary winding 11 is wound only along half the length of the core at most, starting from the core end 13, which is the low voltage side of the secondary winding 5, 6, 7. This embodiment reduces the risk of oversparking between secondary winding and primary winding, as a result of the long distance between the primary winding and the high voltage side of the secondary winding. The capacitive coupling between primary and secondary windings is also achieved at a low voltage difference in comparison with the case when the primary winding is distributed along the full length of the secondary winding. This results in a lower energy boss when creating the ignition pulse.

The inventive ignition transformer thus actually includes three secondary windings and one primary winding.

A specific embodiment intended for use in vehicle headlamps fitted with gas discharge bulbs will now be described with reference to FIG. 1.

The core of the FIG. 1 embodiment has a length of 77 millimeters and a diameter of 6 millimeters.

An insulating Teflon® layer 2 is applied on the core. Two layers 3, 4 of shrink tubing are mounted on top of the Teflon® layer 2. Each secondary winding is comprised or insulation-lacquered copper wire having a diameter of 0.15 millimeter. Each secondary winding has 400 turns, with the wire of each turn lying in abutment with the wire of adjacent turns.

Two layers 9, 10 of shrink tubing are mounted on the outermost of the secondary windings.

The primary winding 11 also comprises insulation-lacquered copper wire, although this wire has a diameter of 0.45 millimeter and is wound through only six turns. A shrink tube 12 is mounted on the primary winding.

This results in a transformer in which the secondary winding has a resistance of 3.95 Ohms.

In accordance with an alternative embodiment, the secondary windings are wound on a first thin plastic tube whose length is the same as the length of the core and which has an inner diameter corresponding to the outer diameter of the core. A thin second plastic tube is then fitted over the secondary winding, this plastic tube having an inner diameter that corresponds to the outer diameter of the outermost secondary winding, whereafter the primary winding is wound on top of the second plastic tube and the core is inserted into the first plastic tube, Finally, a plastic tube or a shrink tube may be fitted on the primary winding. Alternatively, the entire ignition transformer is insulated in a moulding.

The transformer will thus have a low resistance in its operating mode, wherewith current to the bulb is conducted through the secondary winding, while obtaining a sufficiently high ignition voltage. The ignition transformer can also be given a relatively small size, as evident from the above example, and therewith a relatively low weight.

The invention thus solves the problems mentioned in the introduction.

It will be obvious that the inventive ignition transformer can be given dimensions other than those described and that it may include more secondary windings. Other adaptations may also be carried out, depending on the performance required for given applications.

The present invention shall not therefore be considered to be limited by the aforedescribed exemplifying embodiments thereof, since variations and modifications can be made within tire scope of the following Claims.

What is claimed is:

1. An ignition transformer for gas discharge bulbs, comprising a rod-shaped core, a primary winding and a secondary winding that are wound axially on the core, wherein the secondary winding includes at least two mutually concentric and axially extending windings that are mutually connected in parallel at respective ends of the transformer core, wherein each secondary winding is only one layer, and wherein the primary winding includes an axially extending winding that lies concentrically outside the outermost secondary winding.

2. An ignition transformer according to claim 1, wherein the core is a ferrite rod.

3. An ignition transformer according to claim 1, wherein the primary winding is wound along the core over a distance corresponding to at most half the length of the core, beginning from an end of the core that corresponds with the low voltage side of the secondary winding.

4. An ignition transformer according to claim 1, wherein the secondary windings are formed from wire having a diameter of about one-third that from which the primary winding is formed.

5. An ignition transformer according to claim 4, wherein the secondary winding wire diameter is about 0.15 mm.

6. An ignition transformer according to claim 4, wherein the ratio of secondary winding turns to primary winding turns is about 66.7:1.

* * * * *